US006179110B1

(12) United States Patent
Ohkawa et al.

(10) Patent No.: US 6,179,110 B1
(45) Date of Patent: Jan. 30, 2001

(54) BANK NOTE DISCRIMINATING APPARATUS AND BANK NOTE DRAWING MEANS DETECTING METHOD

(75) Inventors: Katsutoshi Ohkawa; Yuuki Saito; Yasumasa Suzuki; Kazuhiko Okamoto, all of Sagamihara (JP)

(73) Assignee: Japan Cash Machine Co., Ltd., Osaka (JP)

( * ) Notice: Under 35 U.S.C. 154(b), the term of this patent shall be extended for 0 days.

(21) Appl. No.: 09/254,834

(22) PCT Filed: Jul. 14, 1997

(86) PCT No.: PCT/JP97/02437

§ 371 Date: Mar. 12, 1999

§ 102(e) Date: Mar. 12, 1999

(87) PCT Pub. No.: WO99/04373

PCT Pub. Date: Jan. 28, 1999

(51) Int. Cl.[7] ..... G07F 7/04
(52) U.S. Cl. ..... 194/203; 194/351
(58) Field of Search ..... 194/203, 351

(56) References Cited

U.S. PATENT DOCUMENTS 4,037,703 * 7/1977 Michaud et al. ..... 194/203
4,348,656 * 9/1982 Gorgone et al. ..... 209/534 X

FOREIGN PATENT DOCUMENTS

602775 * 6/1994 (EP) ..... 194/203

* cited by examiner

*Primary Examiner*—F. J. Bartuska
(74) *Attorney, Agent, or Firm*—Bachman & LaPointe, P.C.

(57) ABSTRACT

A bill validator is provided which comprises a rotator with a slit and being rotatably attached to the bill validator, the slit being capable of aligning with a passageway when the rotator is in an initial position; a driving device for rotating the rotator; and a validator control circuit for judging authenticity of the bill by outputs of detective sensors and for controlling the driving device. The validator control circuit produces outputs to operate the driving device and thereby to rotate the rotator so as to wind some pulling string connected to the bill around the rotator after the bill passes the slit of the rotator, and the circuit evaluates the rotation rate of the rotator, and detects the unauthorized pulling string.

14 Claims, 12 Drawing Sheets

BANK NOTE DISCRIMINATING APPARATUS AND BANK NOTE DRAWING MEANS DETECTING METHOD

FIELD OF THE INVENTION

This invention relates to a bill handling device, in particular to a bill validator capable of preventing unauthorized extraction of a bill by a pulling means such as a string or tape connected to the bill conveyed into the bill validator, and the invention is also directed to a method for detecting the pulling means.

BACKGROUND OF THE INVENTION

For example, Japanese Utility Model Disclosure No. 63-89181 discloses a device for preventing extraction of a bill contained in a bill validator. In such an anti-extraction device, as shown in FIGS. 18 and 19, a bill is inserted from an inlet 207 into a space between a pair of side walls 202 and 203 on a frame 201, and then carried by belts 211 and rollers 212 between protrusions 209 formed on the frame 201 and protrusions 210 formed on a plate 205. When the bill passes the protrusions 209 and 210, it is slightly deformed however, whose deformation is limited within a range that does not prevent transportation of the bill. If a wrong attempt is made to outwardly withdraw the bill through the inlet 207 by pulling a string such as a fishing line connected to the bill after the bill passes an outlet 208, the engagement of the bill with the protrusions 209 and 210 is effective to inhibit extraction of the bill.

Disclosed in Japanese Utility Model Disclosure No. 7-20790 is an anti-extraction device of another type with a stopper which extends into a passageway of a bill validator, but is mounted rotatably away from the passageway in response to a validating signal of the bill validator. This anti-extraction device is very effective to prevent pulling of the bill since the stopper does not rotate away from the passageway unless a genuine bill is transported toward an outlet.

However, the anti-extraction device of FIGS. 18 and 19 cannot detect any pulling means such as a string or tape connected to the bill. Moreover, it is very difficult to provide the protrusions 209 and 210 of their increased extension length because such long protrusions 209 and 210 would make obstacle to transportation of the bill by belts 211 due to engagement of the bill and the protrusions 209 and 210. Therefore, the prior art bill validator is inconveniently subject to unauthorized extraction of bills by strongly pulling a fishing line connected to the bill. In addition, there would be a fear that bills may be damaged by the protrusions 209 and 210 during the transportation even if they can perfectly bar extraction of bills. Accordingly, unauthorized extraction of bills cannot be detected even by the anti-extraction device disclosed in Japanese Utility Model Disclosure No. 7-20790.

DISCLOSURE OF THE INVENTION

Accordingly, an object of the present invention is to provide a bill validator for detecting a pulling means by rotating a rotator after the bill is moved through the rotator in the bill validator.

Another object of the present invention is to provide a bill validator with a rotator rotatably attached to a passageway to wind a pulling means around the rotating rotator to bar unauthorized extraction of a bill.

Still another object of the present invention is to provide a bill validator capable of preventing unauthorized extraction of a bill.

A further object of the present invention is to provide a bill validator with a rotator which can certainly be stopped in position to resist prohibited extraction of a bill.

Still another object of the present invention is to provide a method for and a bill validator with a rotator for detecting a pulling means connected to the bill by rotating the rotator after receiving the bill and measuring rotation rate of the rotator to prevent unauthorized extraction of the bill.

Still further object of the present invention is to provide a bill validator with a rotator and driving device of the rotator which can be prevented from being damaged by inertial force of the rotator motor when the rotator is stopped in position.

A bill validator according to the present invention comprises a case (2); a passageway (3) formed in the case (2) to guide a bill; a conveyer (6) for transporting the bill inserted from an inlet (4) formed at one end of the passageway (3) through the passageway (3) to an outlet (5) formed at the other end of the passageway (3); and a detective sensor (34, 35) disposed adjacent to the passageway (3). The bill validator comprises a rotator (40) rotatably mounted on the bill validator, the rotator (40) being formed with a slit (41) in alignment with the passageway (3) when the rotator (40) is in an initial position; a driving device (70) for rotating the rotator (40); and a validator control circuit (50) for judging authenticity of the bill by outputs from the detective sensor (34, 35). The validator control circuit (50) produces outputs to operate the driving device (70) to rotate the rotator (40) so as to wind around the rotator (40) the pulling means connected to the bill which has passed through the slit (41) of the rotator (40). In the embodiment of the present invention, the slit (41) of the rotator (40) has a tapered surface (46) to guide the bill.

A method for detecting a pulling means of a bill according to the present invention comprises the steps of: transporting the bill inserted from an inlet (4) along a passageway (3) by a conveyor (6), picking up outputs produced by a detective sensor (34, 35) attached along the passageway (3) during transportation of the bill, and moving the bill through a slit (41) of a rotator (40) rotatably disposed on the passageway (3); judging authenticity of the bill by a validating means and transporting by the conveyer means (6) the bill considered genuine to a stacking device (80) for stacking; after the bill passes through the passageway (3), rotating the rotator (40) from the initial position of the slit (41) in alignment with the passageway (3) by a certain angular range and measuring comparative rotation rate or time of the rotator (40); and comparing the comparative rotation rate or time of the rotator (40) with a regular reference rotation rate or time of the rotator (40), and detecting existence of the pulling means when the comparative rotation rate is slower or the rotation time is longer than the reference one.

In the embodiment of the present invention, the method may further comprise any one of the steps of rotating the rotator (40) to the initial position wherein the slit (41) is in alignment with the passageway (3) at the moment a bill is inserted into the inlet (4); previously storing the regular reference rotation rate or time of the rotator (40) rotated by the certain angular range in an unloaded condition without transportation of a bill; positioning the rotator (40) in the initial position while preventing rotation of the rotator (40) from the initial position in one direction; detecting the initial position of the rotator (40) with the slit (41) in alignment with the passageway (3); measuring width of a pulse generated from an encoder (77) connected with a rotator motor (71) for rotating the rotator (40); and measuring a time interval between pulses generated from the encoder (77) connected with the rotator motor (71) for rotating the rotator (40) to evaluate rotation time of the rotator (40).

In the embodiment of the present invention, the method further comprises: measuring pulse width or time interval between pulses generated from the encoder (77) connected with the rotator motor (71) for rotating the rotator (40) by a certain angular range to previously evaluate the unloaded reference rotation rate or time of the rotator (40) before the bill is transported; storing the previously measured reference rotation rate or time of the rotator (40); transporting a bill inserted from the inlet (4) along the passageway (3), validating the bill during the transportation, and then discharging the bill from the outlet (5) of the passageway (3); then rotating the rotator (40) by a certain angular range and measuring width of pulses and time intervals of pulses generated from the encoder (77) connected with the rotator motor (71) to then evaluate a comparative rotation rate or time of the rotator (40); storing the evaluated comparative rotation rate or time of the rotator (40); and comparing the reference and comparative rotation rates or times to detect existence of the pulling means when the comparative rotation rate or time is greater than the unloaded reference rotation rate or time over a certain range. The method may further comprise detecting existence of the pulling means when the comparative rotation time of the rotator (40) for the predetermined angular range is longer than the unloaded reference rotation time of the rotator (40) over a certain period of time.

The bill validator according to this invention comprises a cover (47) for enclosing the rotator (40). In an embodiment of the invention, at least a stepped portion (44) is formed in the rotator (40) in accordance with shape of the cover (47). After a bill is transported through the detective sensor (34, 35) and the slit (41) of the rotator (40) by the conveyer (6), the rotator (40) is rotated to wind around the rotator (40) the pulling means connected to the bill such as string, thread or tape and thereby to prevent unauthorized extraction of the bill.

In this case, rotation of the rotator (40) forcibly squeezes the pulling means into a slight clearance (47*a*) between the rotator (40) and the cover member (47) so that the pulling means exerts the resisting force against rotation of the rotator (40) and rotation of the rotator (40) is slowed down. Accordingly, in comparing the reference rotation rate or rotation time of the rotator (40) in a certain angular range in a regular or unloaded condition without the pulling means with the comparative rotation rate or time of the rotator (40) in the connected condition of the pulling means with the bill, the bill validator can detect the pulling means wound around the rotator (40) because of the comparative slower rotation rate or longer rotation time of the rotator (40) due to the existence of the pulling means.

The bill validator according to the present invention further comprises a lever (60) rotatably mounted on a shaft (62) with a roller (61) rotatably attached on one end of the lever (60); a spring (63) for resiliently urging the roller (61) toward an outer surface of the rotator (40); and a position sensor (66) for detecting rotation of the lever (60). The validator control circuit (50) produces outputs to operate the driving device (70) to rotate the rotator (40) for certain period of time after the bill passes the slit (41) of the rotator (40). The roller (61) on the lever (60) is brought into a notch (65) formed on a periphery of the rotator (40) which thereby is positioned in the initial position where the slit (41) is in alignment with the passageway (3), and as the rotator (40) can rotate in only one direction so that the pulling means cannot be removed from the rotator (40) even by forcibly rotating the rotator (40) from the initial position.

The rotator (40) is drivingly connected with the driving device (70) and rotatable in a certain angular range relative to the driving device (70), and immediately after the roller (61) is brought into the arcuate notch (65) formed on the outer surface of the rotator (40), elasticity of the spring (63) increases the rotation rate of the rotator (40) which is then rotated faster than the driving device (70) to form an angular gap (48) between the preceding rotator (40) and driving device (70). When the roller (61) is fully positioned within the arcuate notch (65), the complete setting of the roller (61) in the notch (65) mechanically stops rotation of the rotator (40). Therefore, the position sensor (66) detects the lever (60) in the initial position to generate an electric signal to the validator control circuit (50) which thereby ceases outputs to the rotator motor (71) to stop the operation of the driving device (70). After the rotator motor (71) is stopped, the driving device (70) continues to rotate under its own inertia power which is gradually decreased during rotation of the driving device (70) along the angular gap (48) to reduce impact force of the driving device (70) on the rotator (40). Also, the rotator (40) is certainly returned to and settled in the initial position to bring the slit (41) of the rotator (40) into alignment with the passageway (3).

In the embodiment of the present invention, the driving device (70) comprises a rotator motor (71), and a gear (45) drivingly connected with the rotator motor (71), and the rotator (40) and gear (45) are rotatably mounted on the same shaft; and the rotator (40) and the gear (45) are rotatable relative to each other by a certain angular range. The gear (45) includes a pair of projections (45*a*); and the rotator (40) includes a pair of arcuate notches (40*a*) for receiving the projections (45*a*) therein.

The case (2) comprises a front housing (2*a*) for covering the detective sensor (34, 35); and a rear housing (2*b*) positioned in the vicinity of the front housing (2*a*) so that the front housing (2*a*) includes a front passage (3*a*) of the passageway (3), and the rear housing (2*b*) includes a rear passage (3*b*) of the passageway (3) adjacently to the front passage (3*a*). The rotator (40) and the driving device (70) are disposed in one of the front and rear housings (2*a*, 2*b*). The rear housing (2*b*) is detachably attached to the front housing (2*a*).

In a standby condition before a bill is inserted into the inlet (4), the slit (41) of the rotator (40) is retained unconformable from the passageway (3) to prevent unauthorized insertion of some tool from the inlet (4) and prohibited extraction of the bill. After the bill is transported through the slit (41) of the rotator (40) and the outlet sensor (36), the rotator (40) is rotated to detect existence of the pulling means by the outlet sensor (36). When the outlet sensor (36) detects the pulling means, the validator control circuit (50) produces a warning signal to an alarm device (80).

BEST MODES FOR EMBODIMENT OF THE INVENTION

Figure 1:
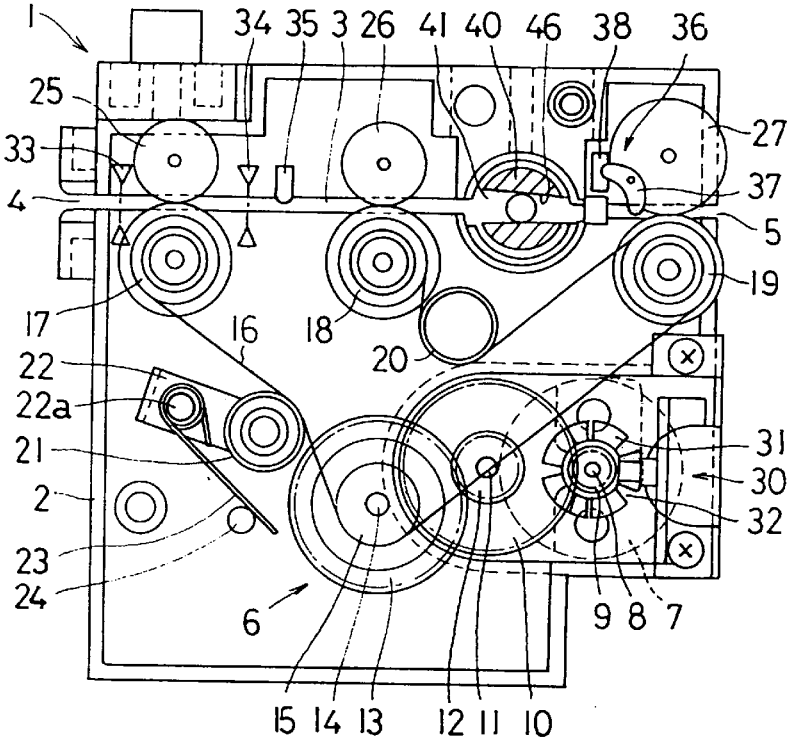
FIG. 1 is a cross-sectional view taken along line I—I of FIG. 3.

As shown in FIG. 1, the bill validator comprises a case 2 and a passageway 3 formed in a case 2 to guide a bill. The passageway 3 is formed between an inlet 4 provided at one end of the case 2 and an outlet 5 provided at the other end of the case 2. A conveyer means 6 for conveying a bill along the passageway 3 comprises a conveyer motor 7, a pinion 9 attached to an output axis 8 of the conveyer motor 7, an intermediate large gear 10 connected with the pinion 9, an intermediate small gear 12 connected with an axis 11 of the intermediate large gear 10, a drive gear 13 connected with the intermediate small gear 12, and a drive pulley 15 connected with an axis 14 of the drive gear 13. A drive belt 16 is wound around the drive pulley 15, each pulley portions of three rollers 17, 18 and 19, and a pulley 20. A portion of the drive belt 16 is downwardly detoured by the pulley 20. The drive belt 16 is resiliently pushed for stretch by a tension pulley 21. One end of a support lever 22 is rotatably attached to the frame 2 by an axis 22*a*, and the tension pulley 21 is rotatably attached to the other end of the support lever 22. Wound around the axis 22*a* is a torsion spring 23, one end of which is attached to the support lever 22, and other end of the torsion spring 23 is attached to a pin 24. The support lever 22 is resiliently urged by the torsion spring 23 to give tension which resiliently inwardly urges the drive belt 16. Pushing rollers 25 to 27 are rotatably disposed opposite respectively to the rollers 17 to 19 to sandwich a bill between the rollers 17, 18, 19 and rollers 25 to 27 in order to surely transport the bill toward the outlet 5 along the passageway 3.

A conveyer encoder 30 is attached to the output axis 8 of the conveyer motor 7, and comprises a disk 31 formed with a plurality of notches 32 on the periphery at constant angular intervals. The conveyer encoder 30 comprises a photo-coupler (not shown) for detecting light through the notches 32 and producing outputs to the validator control circuit 50 of microcomputer shown in FIG. 7. The validator control circuit 50 measures outputs of the photo-coupler per unitary time to detect number of revolution and rotation rate of the conveyer motor 7.

The validator control circuit 50 comprises, not shown but, a discriminating means for receiving an output of optical detective sensor 34 and magnetic sensor 35 to judge authenticity of a bill so that the discriminating means produces outputs to rotate a rotator motor 71 upon receiving an output of the outlet sensor 36 when it judges the bill genuine, and to adversely rotate the conveyer motor 7 and to return the bill to the inlet 4 when it judges the bill false; a pulse generator for generating regular pulses; a memory means for storing reference and comparative rotation times and rates of the rotator 40 by counting number of regular pulses from the pulse generator during rotation of the rotator 40 before and after transportation of the bill; and a comparing means for comparing the reference and comparative rotation times and rates of the rotator 40 stored in the memory means before and after transportation of the bill to generate a warning output when the comparative rotation time and rate of the rotator 40 after transportation of the bill exceed the unloaded reference rotation time and rate of the rotator 40 before the transportation of the bill over a predetermined range.

As shown in FIG. 1, an inlet sensor 33 is attached in the vicinity of the inlet 4 adjacent to the passageway 3 to detect a bill inserted from the inlet 4. Also, an optical detective sensor 34 and a magnetic detective sensor 35 are attached behind the inlet sensor 33, an outlet sensor 36 is attached in the vicinity of the outlet of the passageway 3. For instance, the inlet sensor 33 may comprise a photo-coupler of a light-emitting diode and a phototransistor. The optical detective sensor 34 may be of a photo-coupler which has a light-emitting means and light sensitive means, the light emitting means producing an infrared ray, and the light sensitive means capable of receiving the light reflected on a surface of a bill or penetrating the bill to detect an optical pattern (optical characteristics) of a bill. The magnetic detective sensor 35 may be of a magnetic head or a Hall sensor for detecting a magnetic component (magnetic characteristics) of ink printed on a bill. The optical and magnetic detective sensors 34, 35 produce outputs to the validator control circuit 50. The outlet sensor 36 includes a rotatably pivoted bend lever 37 and a photo-coupler 38 attached adjacent to the bend lever 37. A bill transported through the passageway 3 contacts one end of the bend lever 37 which is then rotated by the bill so that the other end of the bend lever 37 interrupts or penetrates light of the photo-coupler 38. Thus, the photo-coupler 38 of the outlet sensor 36 can detect passage of the front and rear edges of the bill to forward outputs to the validator control circuit 50. Not shown but, a stacker device is provided adjacent to the outlet 5 to accumulate in order bills discharged from the outlet 5 in a layered condition.

The rotator 40 is rotatably mounted between the roller 18 and the outlet sensor 36 and perpendicularly to the longitudinal direction of the passageway 3. As shown in FIGS. 1 and 3, the rotator 40 comprises a stem 42 of a generally cylindrical shape formed with a plurality of stepped portions 44 on the periphery; a slit 41 formed longitudinal of the cylindrical shape in the stem 42; a pair of shafts 43 coaxially provided at both ends of the stem 42; and an one-way clutch 43a disposed between the stem 42 and one of the shafts 43. A pair of cover members 47 are provided to surround a circumstance of the stem 42 since each of the cover members 47 has compensatory shape with stepped portions 44 of the stem 42. These cover members 47 are positioned in vertically spaced relation to each other not to obstruct the passageway 3. A small clearance 47*a* of about 0.5 mm is formed between the rotator 40 and cover members 47, and stepped portions 44 are formed to prevent jamming of the bill which may enter the clearance 47*a* into stick during transportation of the bill through the passageway 3. The rotator 40 is rotated by a driving device 70 only in a clockwise direction in FIG. 2 by one-way clutch 43*a* to release an arcuate notch 65 from a roller 61, but to inhibit rotation of the rotator 40 in the counterclockwise direction.

When the slit 41 is in alignment with the passageway 3, a bill can be transported through the passageway 3 and the slit 41 toward the outlet 5. The slit 41 includes tapered surfaces 46 converging or narrowing in the transporting direction. The tapered surfaces 46 permit to smoothly guide a bill through the slit 41 along the passageway 3 toward the outlet 5 without jamming and for smooth transportation, and facilitate removal of the stem 42 from a mold when it is made of resin. Both ends of the shaft 43 are rotatably supported on corresponding bearings 43*a*.

Figure 2:
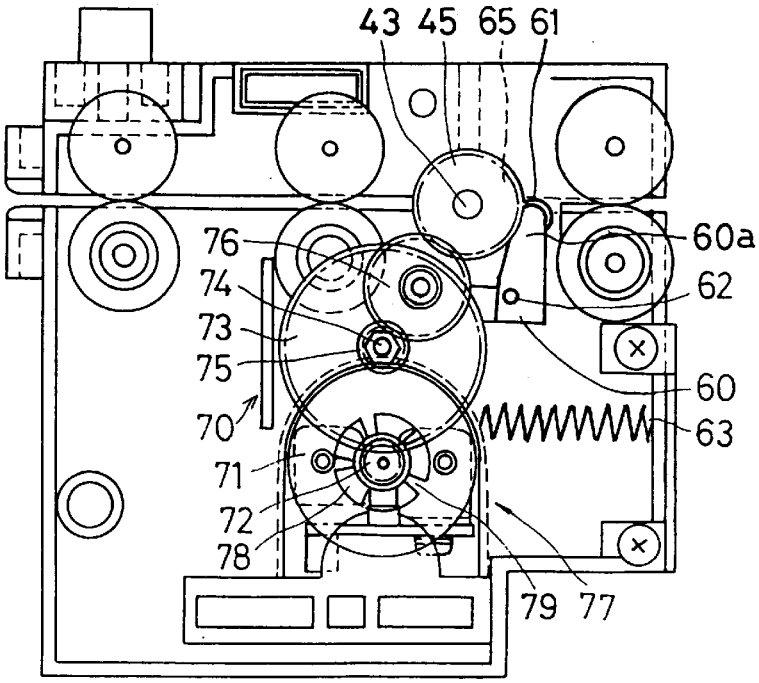
FIG. 2 is a cross-sectional view taken along line II—II of FIG. 3.
Figure 3:
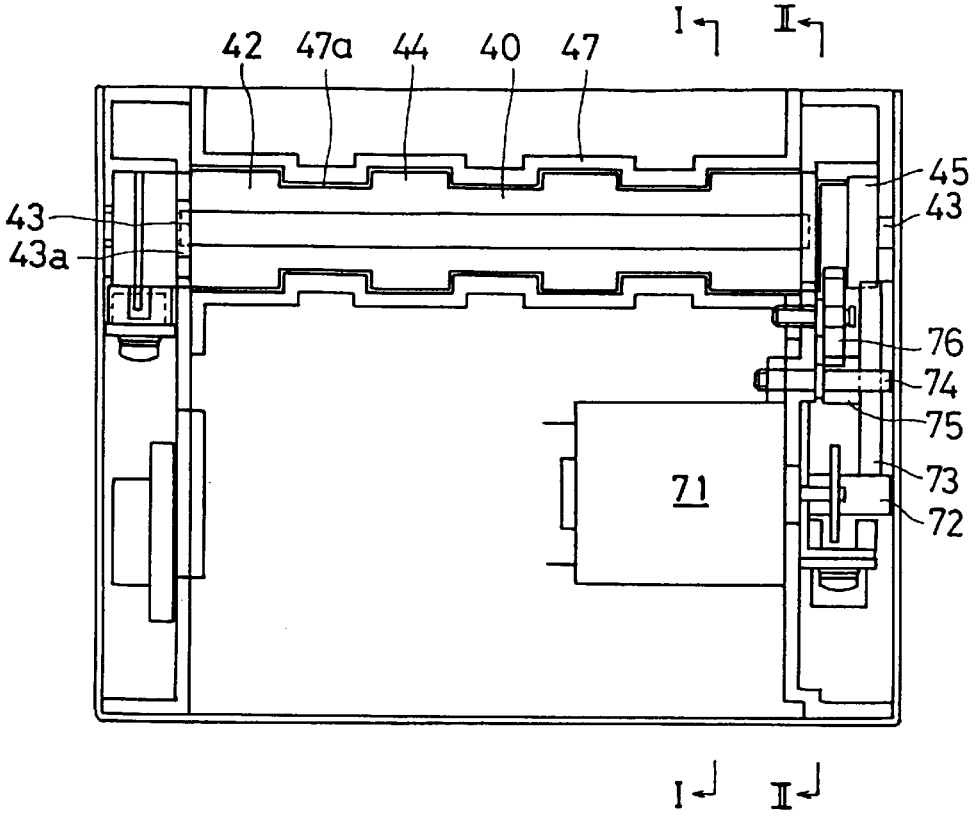
FIG. 3 is a cross-sectional view of a bill validator according to the present invention.
Figures 5A, 5B, 5C, 5D, 5E:
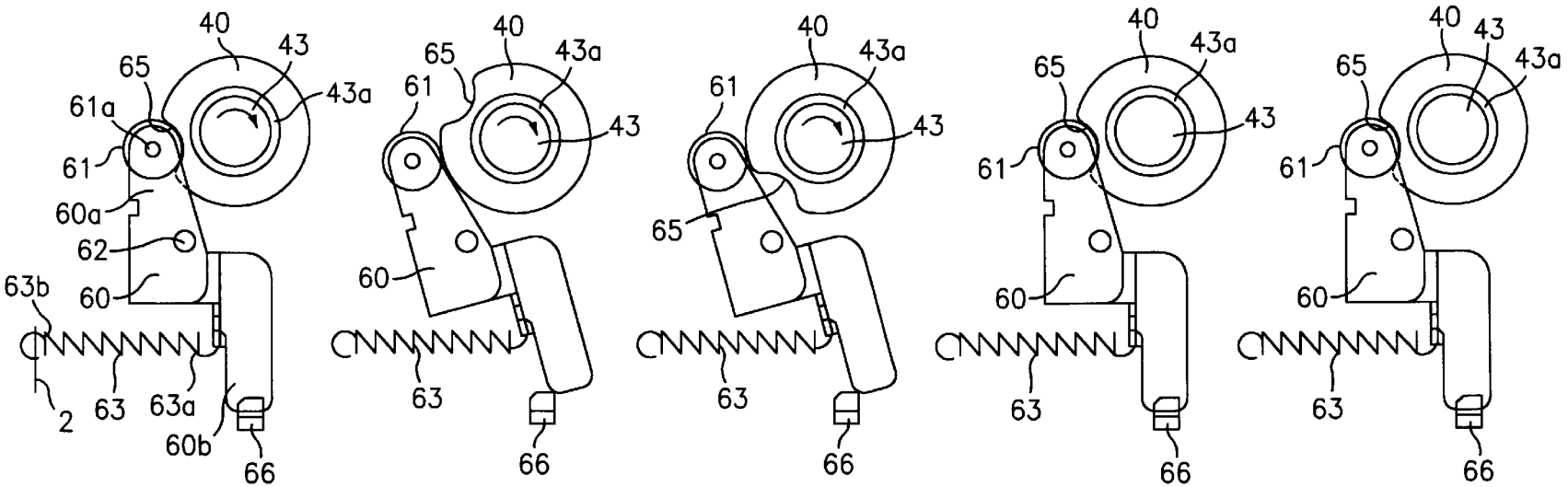
FIGS. 5*a*–5*e* indicates sequential views showing an operational relationship between a lever and a rotator.

As shown in FIGS. 2 and 5*a*, the rotator 40 is formed with an arcuate notch 65 on the periphery to receive a roller 61 of a lever 60 rotatably supported on a shaft 62 at the generally central portion when the rotator 40 is in the initial position. The roller 61 is rotatably supported at one end 60*a* of the lever 60 via an axis 61*a*. One end 63*a* of a spring 63 is connected with around the other end 60*b* of the lever 60, and the other end 63*b* of the spring 63 is connected with the case 2. The spring 63 resiliently urges the lever 60 for rotation around the shaft 62 to always bring the roller 61 into contact with an outer surface of the rotator 40 and thereby to engage the roller 61 with the arcuate notch 65. Mounted in the vicinity of the other end 60*b* of the lever 60 is a position sensor 66 of non-contact type such as a photo-coupler to detect the roller 61 in engagement with the arcuate notch 65 or the rotating condition of the lever 60. When the roller 61 is received in the arcuate notch 65, the other end 60*b* of the lever 60 interrupts light of the position sensor 66 which therefore produces an output "0". When the rotator 40 rotates, the roller 61 comes out of the notch 65 so that the end 60*b* of the lever 60 is simultaneously moved away from the position sensor 66 which then produces an output "1".

To rotate the rotator 40, as shown in FIG. 2, the driving device 70 comprises a rotator motor 71; a pinion 72 mounted on an output shaft of the rotator motor 71; a large gear 73 engaged with the pinion 72; a small gear 75 secured on a shaft 74 of the large gear 73; a middle gear 76 engaged with the small gear 75 and a gear 45 attached to a shaft 43 of the rotator 40. When the rotator motor 71 is driven to rotate the rotator 40, the roller 61 of the lever 60 comes out of the notch 65 against elasticity of the spring 63. Therefore, the arcuate notch 65 is disengaged from the roller 61 against elasticity of the spring 63 to rotate the lever 60 around the shaft 62 in the clockwise direction in FIG. 2.

Figure 6A:
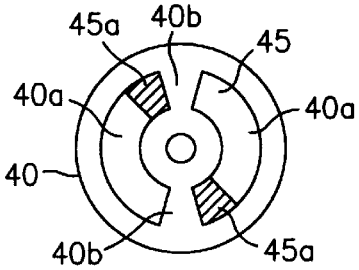
FIGS. 6*a*–6*e* indicates sequential views showing an operational relationship between the rotator and a gear of a driving device.

As shown in FIG. 6*a*, the rotator 40 comprises a pair of arcuate notches 40*a*, and connecting portions 40*b* formed at both ends of the notches 40*a*. A gear 45 is formed with a pair of projections 45*a* received in the corresponding notches 40*a* of the rotator 40. The projections 45*a* extend in the axial direction of the gear 45 and are positioned within the notches 40*a* for relative rotation in a certain angular range.

Figure 7:
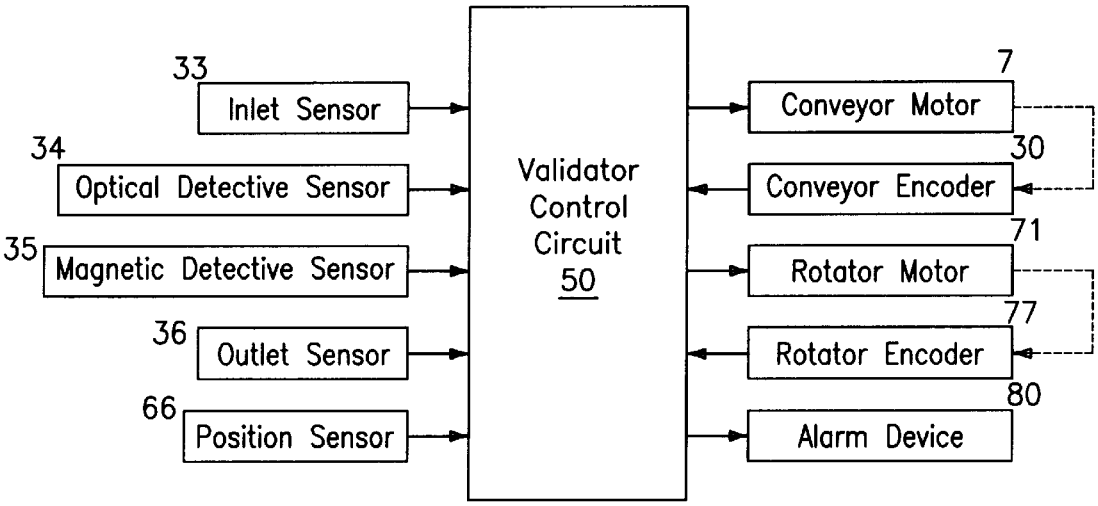
FIG. 7 is a block chart of the bill validator of microcomputer according to this invention.

As shown in FIG. 7, input terminals of the validator control circuit 50 are connected with the inlet sensor 33, optical detective sensor 34, magnetic detective sensor 35, outlet sensor 36 and position sensor 66. Output terminals of the validator control circuit 50 are connected with the conveyer motor 7, conveyor encoder 30, rotator motor 71, rotator encoder 77 and alarm device 80. Attached to the output axis of the rotator motor 71 is the rotator encoder 77 which has a disk 78 formed with a plurality of notches 79 at certain angular intervals. The rotator encoder 77 includes a photo-coupler not shown for detecting interruption of light from the photo-coupler through the notches 79 to generate outputs to the validator control circuit 50. The validator control circuit 50 counts outputs from the photo-coupler of the rotary encoder 77 per unitary time to detect the number of rotation and the rotation rate of the rotator motor 71.

Operation of the validator control circuit 50 shown in FIG. 7 is described hereinafter in connection with FIG. 8.

Figure 4:
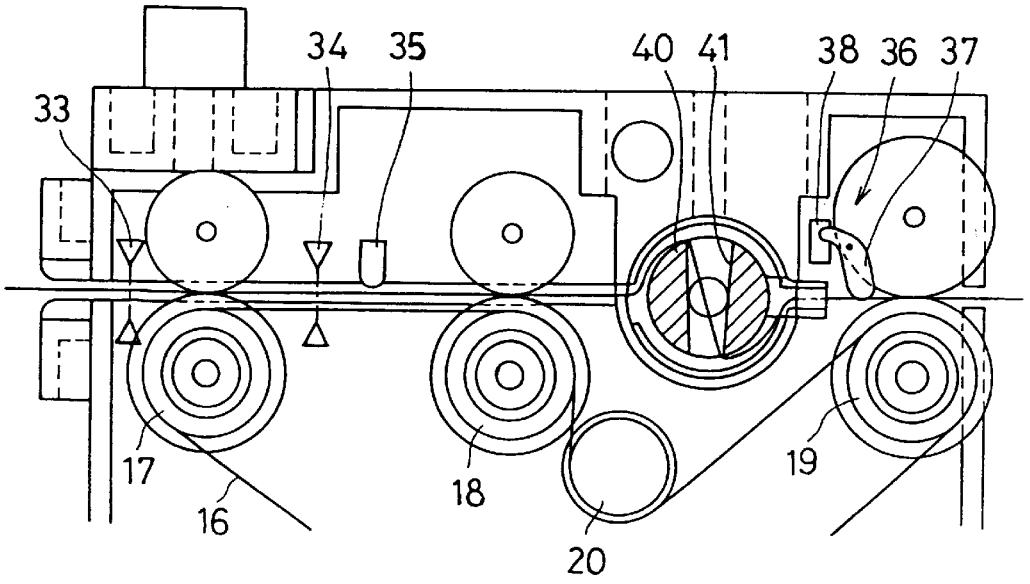
FIG. 4 is a partially enlarged view of FIG. 1.

When processing of the validator control circuit 50 moves from Step 100 to 101, it is on standby detecting whether a bill is inserted into the inlet 4. In the standby condition before a bill is inserted into the inlet 4, the slit 41 of the rotator 40 is retained substantially perpendicular to the passageway 3 for unconformity from the passageway 3 as shown in FIG. 4. When the bill is inserted into the inlet 4 at the end of the passageway 3, the inlet sensor 33 detects insertion of the bill to generate an output to the validator control circuit 50. Then, in Step 102, the validator control circuit 50 forwards outputs to drive the conveyer motor 7 and thereby transport the bill along the passageway 3, and in Step 103, the circuit 50 also activates the optical and magnetic detective sensors 34, 35. After that, the validator control circuit 50 gives rise to outputs to drive the rotator motor 71 in Step 104, and then decides whether the position sensor 66 is turned ON in Step 105. As the roller 61 of the lever 60 comes into engagement with the arcuate notch 65 of the rotator 40 by virtue of elasticity of the spring 63, the position sensor 66 can detect engagement of the roller 61 with the arcuate notch 65 to produce an output to the validator control circuit 50. After the position sensor 66 is turned ON, the validator control circuit 50 ceases to rotate the rotator motor 71 and rotator encoder 77 in Step 106. As the roller 61 is properly engaged with the notch 65, the rotator 40 is in the initial position where the slit 41 is perfectly aligned with the passageway 3. In step 107, the memory means stores information of rotation time and rate of the rotator 40 required for one revolution in response to outputs from the rotator encoder 77. Subsequently, the bill is carried through the passageway 3 and the slit 41 of the rotator 40 to the outlet 5.

When the bill passes the optical and magnetic detective sensors 34, 35 during travel along the passageway 3, the validator control circuit 50 receives outputs from the optical and magnetic detective sensors 34, 35 to determine authenticity of the transported bill (in Step 108). When the validator control circuit 50 determines that the bill is genuine in view of the optical and magnetic characteristics, it watches in Step 109 whether the outlet sensor 36 detects passage of the bill. When the front edge of the bill passes the outlet sensor 36, it rotates the bend lever 37 so that the photo-coupler 38 of the outlet sensor 36 produces an output representative of detection of the bill's front edge upon rotation of the lever 37. In addition, after the rear edge of the bill passes the outlet sensor 36, the bend lever 37 returns to the initial position due to its own weight so that the photo-coupler 38 produces an output upon passage of the bill's rear end. Once the outlet sensor 36 detects passage of the bill in Step 109 in this way, operation of the conveyer motor 7 is stopped in Step 110 because the bill completely passes through the outlet sensor 36 and the outlet 5.

After the bill passes the outlet 5 and outlet sensor 36, and the conveyer motor 7 has stopped rotation, the validator control circuit 50 produces an output to the rotator motor 71 to rotate the rotator 40 one revolution in Step 111. In Step 112, the validator control circuit 50 watches whether the rotator 40 has rotated one revolution, and when it rotates a whole angle of 360 degrees, the position sensor 66 detects the rotation position of the lever 60 and produces an output to stop rotation of the rotator motor 71. The unloaded rotation time and rate of the rotator 40 required for one revolution are stored as reference in the memory means in Step 107, and after packing of the bill in the stacker device, the rotator 40 is rotated again one revolution in Step 112 to detect comparative rotation time and rate of the rotator 40, and then comparison is made between the comparative rotation time and rate with the reference rotation time and rate of the rotator 40. Thus, the comparing process needs the further rotation of the rotator 40 in Step 112.

Figure 6B:
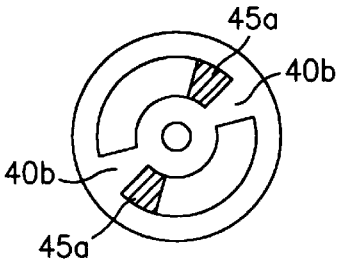
Figure 6C:
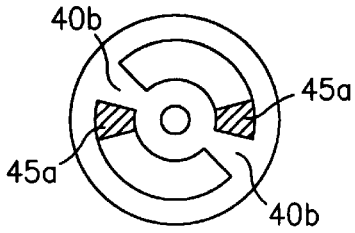
Figure 6D:
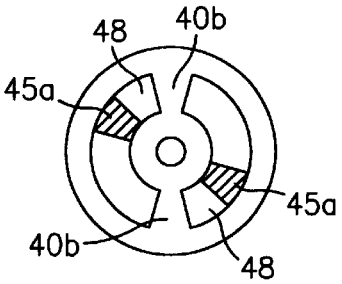
Figure 6E:
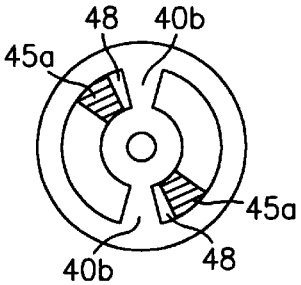
Figure 10:
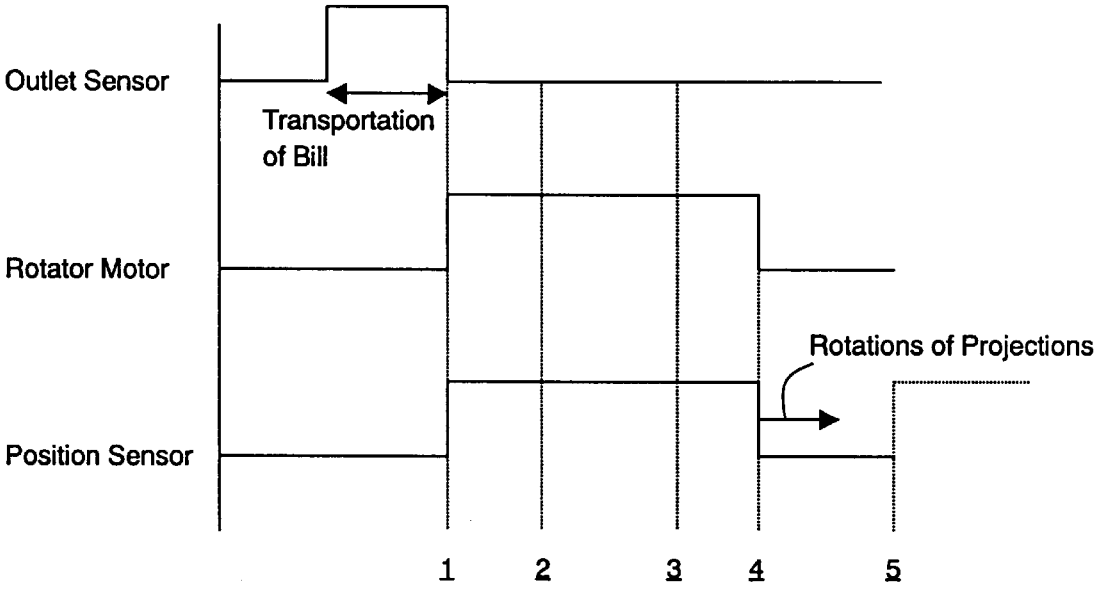
FIG. 10 is an operational timing chart of a outlet sensor, rotator motor and position sensor.
Figure 11:
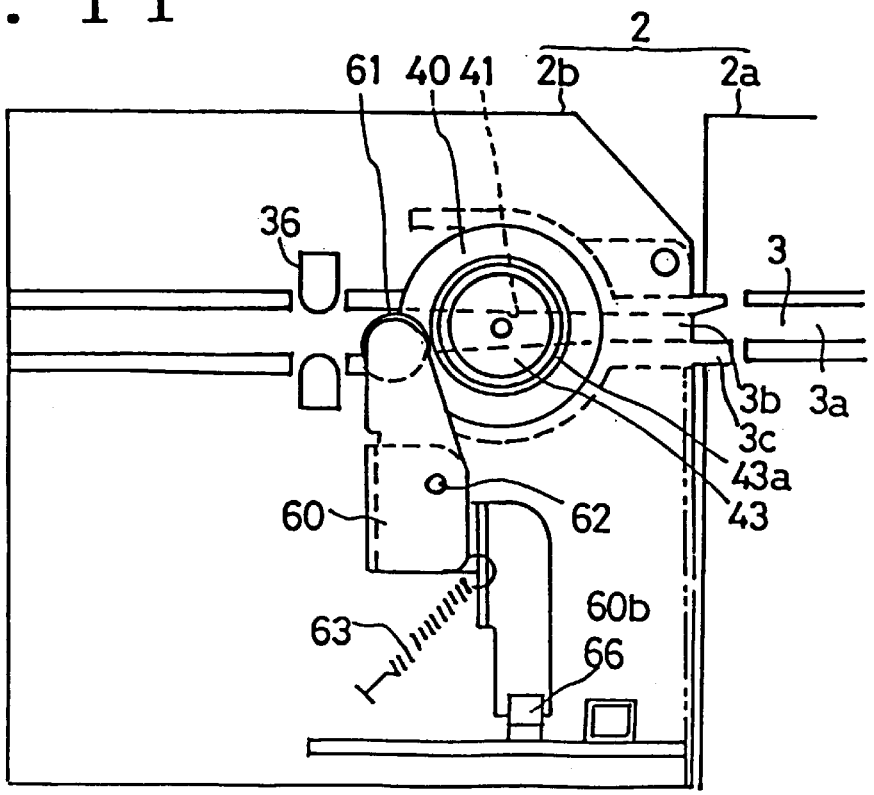
FIG. 11 is a cross-sectional view showing another embodiment of this invention.
Figure 12:
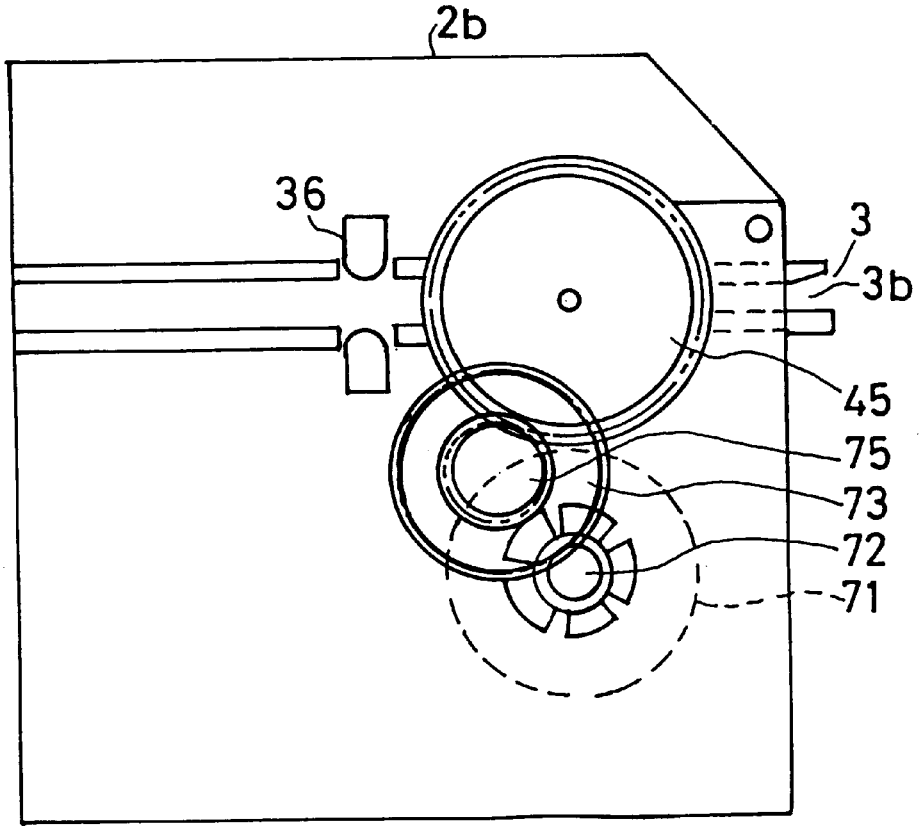
FIG. 12 is a cross-sectional view of the driving device according to another embodiment of this invention.

When the bill passes the outlet sensor 36 which then detects completion of the bill's passage, the outlet sensor 36 produces an output as shown in FIG. 10, and thereby the validator control circuit 50 produces an output to rotate the rotator motor 71 so that the projections 45*a* of the gear 45 rotate the rotator 40 in contact with the connecting portion 40*b* of the rotator 40 as shown in FIG. 6*b*. At this time, as shown in FIG. 5*b*, the roller 61 is radially outwardly moved against elasticity of the spring 63, and simultaneously, the other end 60*b* of the lever 60 is moved away from the position sensor 66 which then generates an output "1". When the rotator 40 is further rotated with the notch 65 just before the roller 61 as shown in FIGS. 5*c* and 6*c*, the roller 61 pushes an edge of the notch 65 in the rotational direction by virtue of elasticity of the spring 63. Accordingly, when the roller 61 goes into the notch 65 as shown in FIG. 5*d*, the rotator 40 rotates faster than the gear 45 as shown in FIG. 6*d* to form an angular gap 48 between the projection 45*a* of the gear 45 and the connecting portion 40*b*. In the initial condition shown in FIG. 5*d*, the position sensor 66 changes its output from "1" to "0" (FIG. 10) to thereby stop operation of the rotator motor 71. In this case, the rotating driving device 70 including the rotator motor 71, large gear 73 and middle gear 76, provides the inertial force which is decreased after the rotator motor 71 is stopped and during rotation of the projection 45*a* along the angular gap 48 so that the rotator 40 can certainly be retained in the initial position as shown in FIG. 5*a* because the projections 45*a* do not produce large impact force on the connecting portions 40*b* due to formation of the angular gap 48, and the projections 45*a* may stop in spaced relation to the connecting portion 40*b* of the rotator 40 with the angular gap 48 as shown in FIGS. 5*e* and 6*e*. In this way, the rotator 40 can be surely brought into the initial position wherein the slit 41 is registered with the passageway 3.

Next, the validator control circuit 50 determines whether the pulse width of the rotator encoder 77 is in a predetermined time interval (in Step 113) and whether the comparative rotation time and rate of the rotator 40 required for one revolution are in datum ranges (in Step 114) in comparing with the reference rotation time and rate stored in Step 107.

If some pulling means such as string, thread or tape is connected with the bill transported through the outlet 5 as shown in FIG. 4, it extends through the passageway 3 and the slit 41 of the rotator 40 so that when the rotator 40 is rotated one revolution in Step 112, the pulling means is wound around the rotator 40 entering the clearance 47*a* between the rotator 40 and the cover members 47. When the pulling means is sandwiched between the rotator 40 and the cover member 47, it offers resistance to rotation of the rotator 40 so that irregular pulses may be generated from the rotator encoder 77, or rotation rate of the rotator 40 may be slowed down relative to the unloaded reference rotation rate before transportation of the bill. Consequently, when the pulse width of the rotator encoder 77 is not in a predetermined range of time length in Step 113, or when the rotation time of the rotator 40 required for one revolution is not in a datum range in Step 114 set based on the reference rotation time stored in Step 107, the validator control circuit 50 decides that some pulling means is connected with the bill, and forwards a warning signal to the alarm device 80*a* for activation in Step 125, and the stage moves to Step 126. The pulling means wound around the periphery of the rotator 40 can be removed by opening the case 2 and then rotating the rotator 40. When the pulse width of the rotator encoder 77 is in the predetermined range of time length in Step 113, or when the rotation time of the rotator 40 required for one revolution is in the datum range in Step 114 set based on the reference rotation time stored in Step 107, the validator control circuit 50 decides that no pulling means is connected with the bill, and the stage goes to Step 115.

Subsequently, in Step 115, the rotator motor 71 is operated to rotate the rotator 40 by 0.75 (¾) revolution, and when the validator control circuit 50 determines that the rotator 40 has rotated for a certain period of time to ¾ revolution in Step 116, the operation of the rotator motor 71 is stopped in Step 117. In this case, the slit 41 of the rotator 40 is kept perpendicular to the passageway 3 to shut the passageway 3 by the rotator 40 in order to prevent unauthorized insertion of some tool or prohibited extraction of the bill from the stacker device. In Step 118, the validator control circuit 50 observes whether the outlet sensor 36 is kept ON or not. If the bill has been accumulated in the stacker device, the outlet sensor 36 is kept OFF, however, if the bill is disposed adjacent to the sensor 36 due to the extraction by the pulling means, the validator control circuit 50 decides that the bill is extracted by the pulling means and produces a waning signal in Step 125 because the outlet sensor 36 is kept ON in Step 118 despite passage of the bill through the outlet sensor 36. When the outlet sensor 36 is in the OFF condition in Step 118, the bill is accumulated in the stacker device in Step 119 and the processing moves to Step 126.

When the validator control circuit 50 does not find the bill genuine in Step 109, it stops rotation of the conveyer motor 7 and adversely rotates it in Steps 120 and 121 to return the bill to the inlet 4. When the inlet sensor 33 is switched OFF in Step 122, the validator control circuit 50 stops driving of the conveyor motor 7 (in Step 123) for complete discharge of the bill (in Step 124) to go to Step 126.

FIG. 7 shows another embodiment of the validator control circuit 50 composed of discrete circuits. When the inlet sensor 33 detects insertion of the bill, the pulse shaping circuit 130 such as one-shot multivibrator switches a RJS flip-flop 131 to the SET condition to drive the rotator motor 71 through an OR gate 132. Since the rotator encoder 77 provides an AND gate 140 with pulses during rotation of the rotator motor 71, a first counter 142 counts number of pulses from the pulse generator 141 while the rotator encoder 77 produces an ON pulse. Thus, the first counter 142 measures regular pulses from the pulse generator 141 to evaluate the pulse width of each pulse generated from the rotator encoder 77 and thereby to determine the real time change in rotation rate of the rotator 40. The first counter 142 also measures the total rotation time of the rotator motor 71 necessary for one revolution of the rotator 40. A discriminating circuit 143 receives outputs from the optical and magnetic detective sensors 34, 35 to judge whether the bill has the predetermined optical or magnetic characteristics. When the discriminating circuit 143 considers the bill genuine, it produces an output from the OK terminal, and in this case, when the outlet sensor 36 produces an output through a pulse shaping circuit 144, an AND gate 145 is turned ON and an R/S flip-flop 146 is set. When the rotator encoder 77 produces an ON pulse, a second counter 148 counts number of pulses generated from the pulse generator 141 through an AND gate 147 by output of the R/S flip-flop 146. The second counter 148 counts regular pulses for unitary time from the pulse generator 141 after the bill passes the slit 41 to evaluate the pulse width of each pulse generated from the pulse generator 141 and thereby to determine the real time change in rotation rate of the rotator 40. The second counter 148 also measures the total rotation time of the rotator motor 71 necessary for one revolution of the rotator 40 after the bill passes the slit 41. When the rotator 40 rotates one revolution, the position sensor 66 produces an output so that a pulse forming circuit 133 produces an output to reset the R/S flip-flop 146 and thereby to stop rotation of the rotator motor 71. A comparing means 150 compares the unloaded reference rotation rate and total rotation time of the rotator 40 stored in the first counter 142 before transportation of the bill with the comparative rotation rate and total rotation time of the rotator 40 stored in the second counter 148 after transportation of the bill. When the comparative rotation rate and total rotation time of the rotator 40 stored in the second counter 148 are not in a predetermined datum range set based on the reference rotation rate and total rotation time of the rotator 40 stored in the first counter 142, the comparing means 150 produces an output to operate the alarm device 80. When the discriminating circuit 143 cannot regard the bill as genuine, it produces an output from the NG terminal to set a R/S flip-flop 149 in order to adversely rotate the conveyer motor 7. When the bill is returned to the inlet 4 and the inlet sensor 33 produces an output, the R/S flip-flop 149 is reset.

While FIGS. 1 and 4 illustrate an example of the detective sensors 34, 35 positioned in a front housing 2*a* of the case 2 with a front passage 3*a* of the passageway 3, it is not always necessary to dispose the rotator 40 or the driving device 70 in the front housing 2*a*, instead, it is also possible to locate them anywhere in the case 2 or in the passageway 3 to the stacker device for stacking the bill discharged from the case 2. For example, the rotator 40 or the driving device 70 may be provided in a connecting portion between the case 2 and the stacker device. FIGS. 12 to 18 show examples of a rear housing 2*b* adjacent to the front housing 2*a* wherein the rear housing 2*b* contains the rotator 40, driving device 70 and a rear passage 3*b* adjacent to the front passage 3*a*. The rear housing 2*b* is detachably attached to the front housing 2*a* by a suitable hook means.

Figure 13:
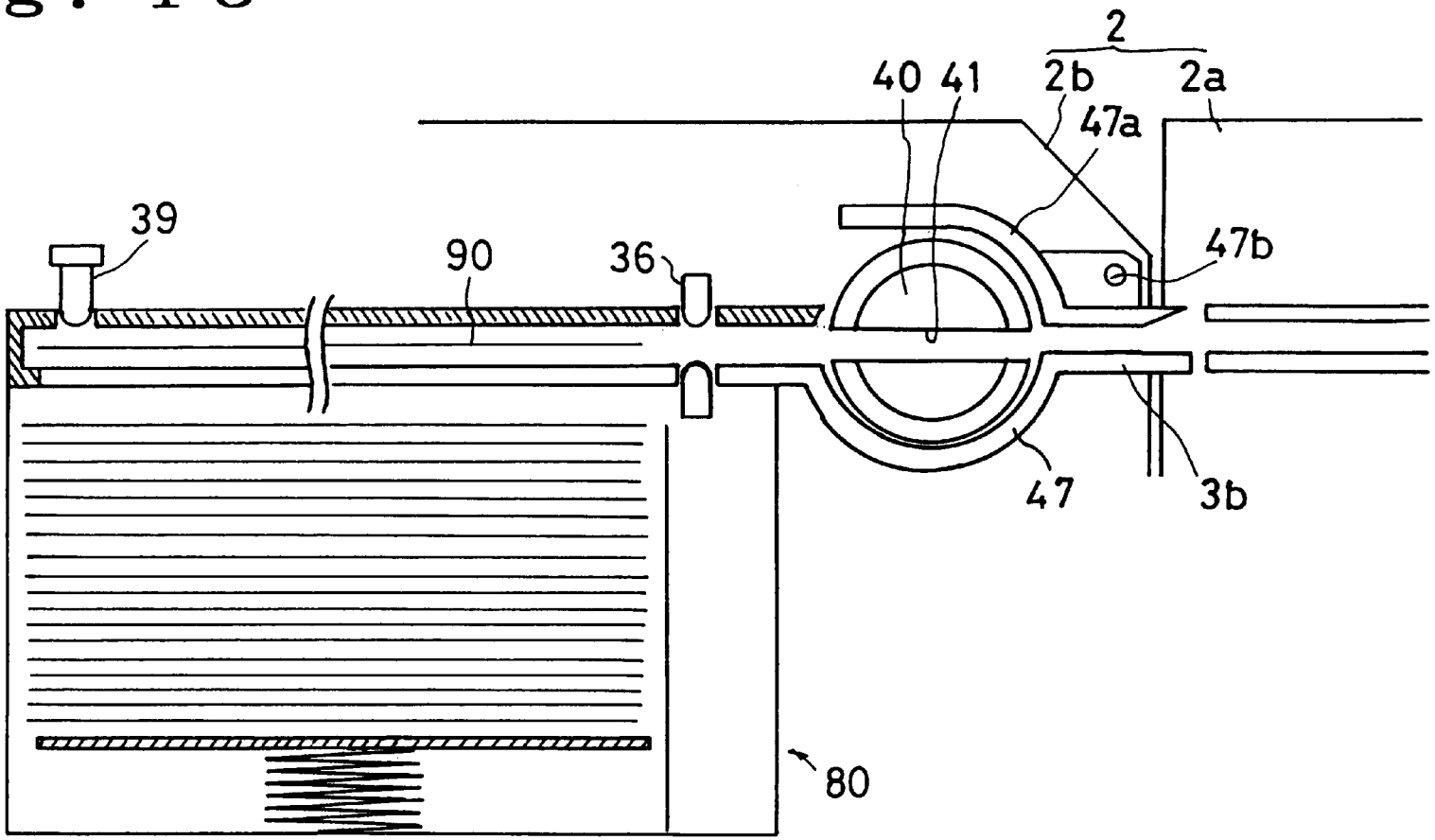
FIG. 13 is a cross-sectional view of the embodiment shown in FIG. 11 and connected with a stacker device.
Figure 14:
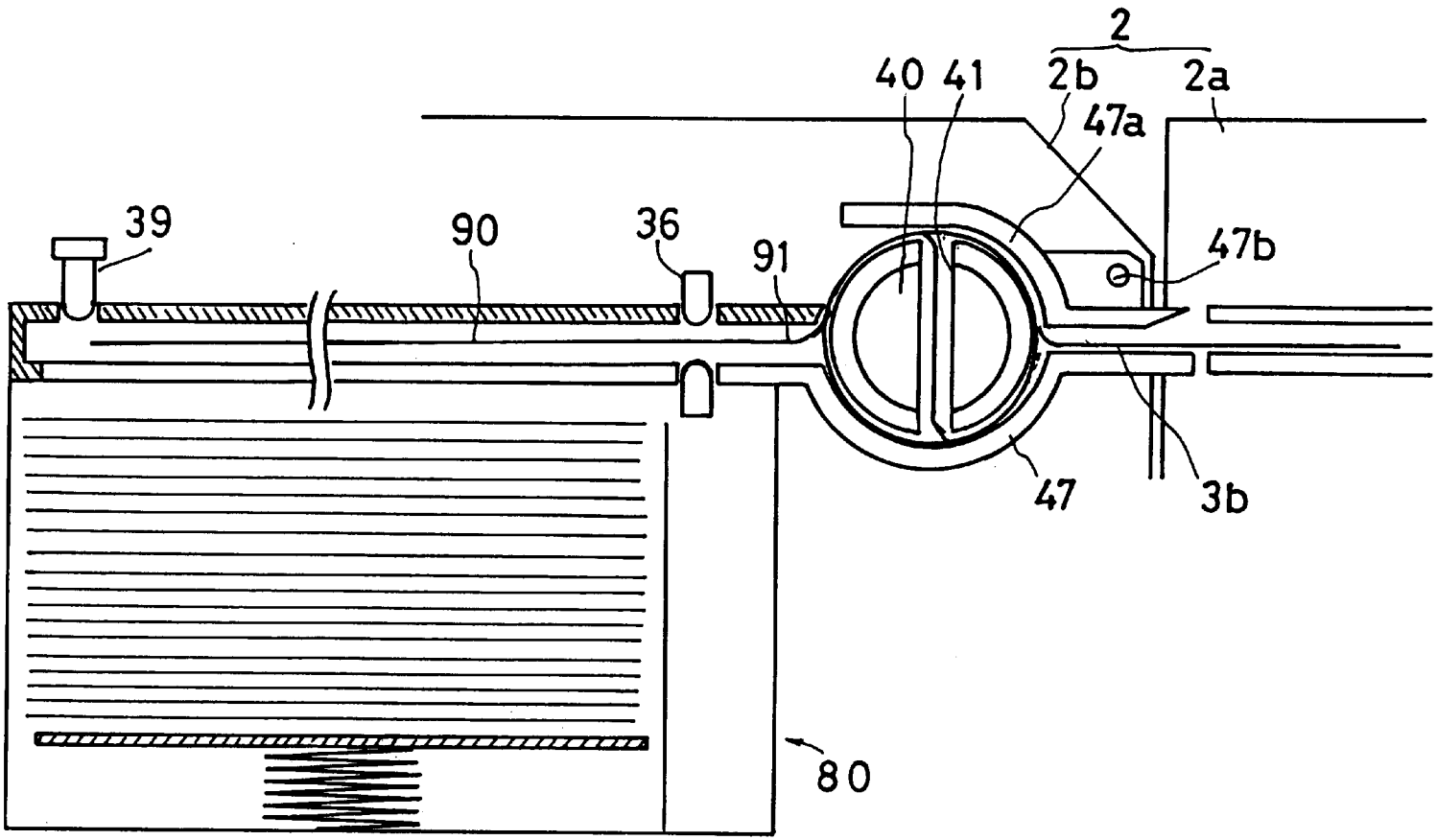
FIG. 14 is a cross-sectional view of the rotated rotator shown in FIG. 13.
Figure 15:
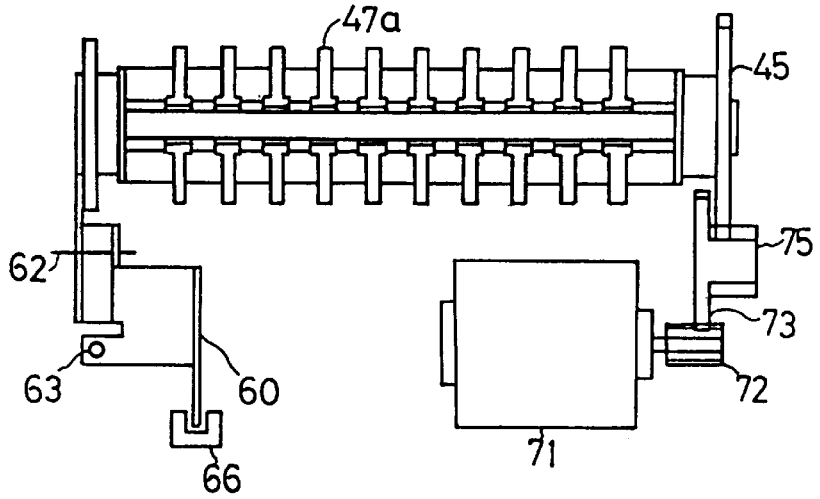
FIG. 15 is a longitudinal cross-sectional view of the rotator according to another embodiment.
Figure 16:
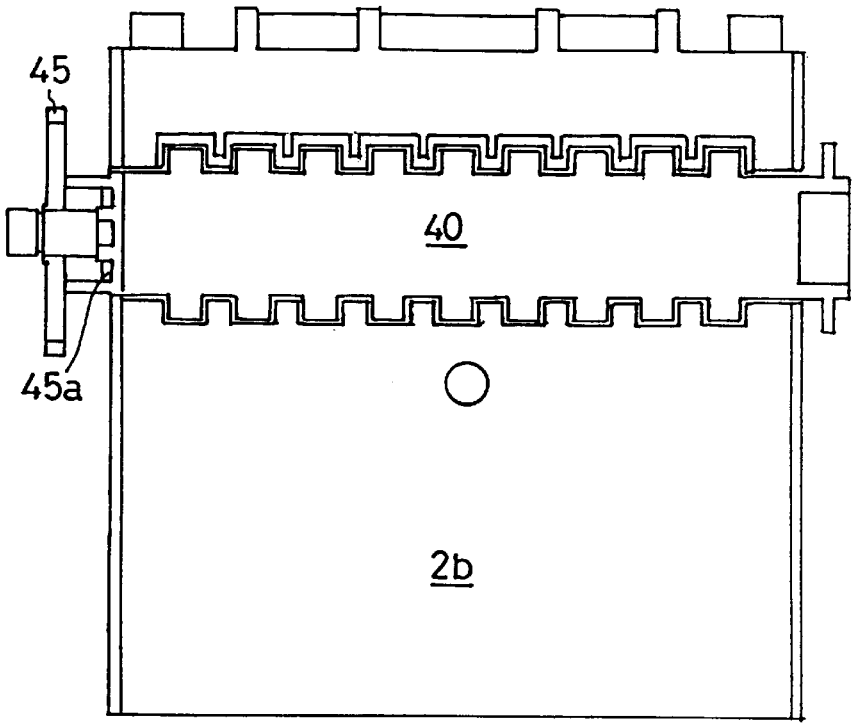
FIG. 16 is a longitudinal cross-sectional view of the rotator with the driving device in another embodiment.

In an embodiment shown in FIGS. 11 to 17, the rotator 40 is provided in the rear housing 2*b*, and the outlet sensor 36 and an end sensor 39 for detecting an end of the bill are provided behind the rotator 40. The rear passage 3*b* extends through the slit 41 of the rotator 40 backward of the outlet sensor 36. A guide member 3*c* extends forward from the rear housing 2*b* for connection with the front passage 3*a* in the front housing 2*a* to form an entrance of the rear passage 3*b* for the smooth passageway 3. As shown in FIGS. 13 and 14, provided rearward of the outlet sensor 36 is a stacker device 80 with the end sensor 39 to detect the position of the bill 90 when packing it in the stacker device 80. When the bill is transported into the inner end of the passageway 3 beyond the outlet sensor 36, it produces no detection signal without pulling means connected with the bill 90.

Figure 8:
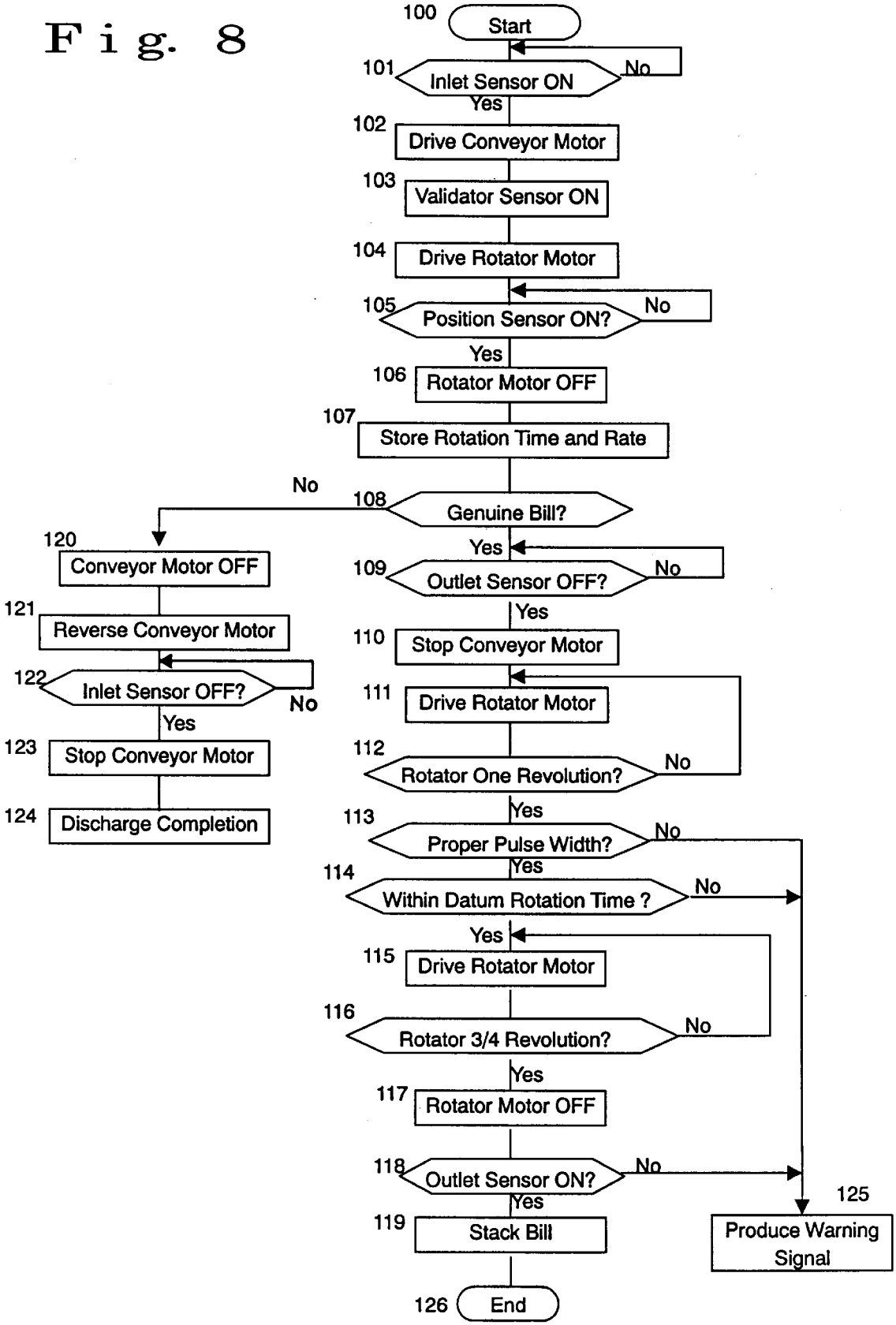
FIG. 8 is a flow chart indicating an operational sequence of the validator control circuit shown in FIG.5.
Figure 9:
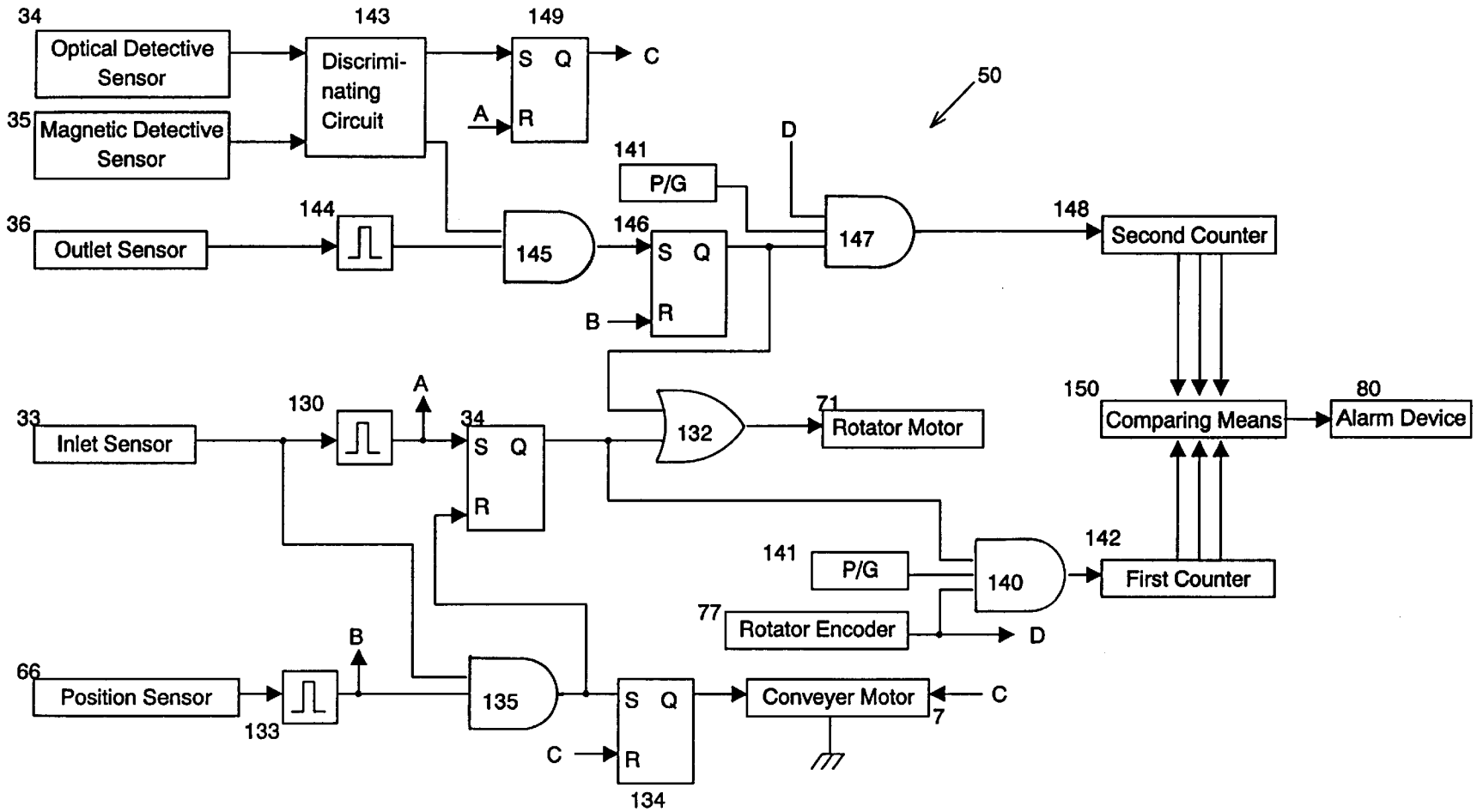
FIG. 9 is an electric circuit of the bill validator according to this invention which comprises discrete elements.

In Step 119 of FIG. 8, the validator control circuit 50 judges whether the outlet sensor 36 is ON or not. When the bill is put in the stacker device 80, the outlet sensor 36 indicates the OFF output, but when a pulling means 91 is connected with the bill 90 as shown in FIG. 14 for extraction, the pulling means 91 or the bill 90 extends through or is disposed adjacent to the outlet sensor 36 so that it produces the ON output in Step 119 to the validator control circuit 50 which therefore recognizes the extraction of the bill by the pulling means 91 and produces a warning signal in Step 125. When the outlet sensor 36 produces the OFF output, the routine comes to Step 126.

The present invention is not limited to the foregoing embodiments and may be modified in various ways. For example, Step 112 measures rotation time and rate of the rotator 40 for one revolution, however, the rotator 40 may be rotated by a given or predetermined angular range to detect the pulling means. Also, in the preceding embodiments, the memory means stores the reference rotation time and rate of the rotator 40 for one revolution in Step 107, and the rotator 40 is rotated one revolution in Step 112 to evaluate the comparative rotation time of the rotator 40 for comparison with the reference rotation time and rate stored in Step 107. However, the pulse width and rotation time of the rotator 40 may be compared in Step 113 and 114 with a reference pulse width and reference rotation time previously installed by programming without processing in Step 107.

A plurality of arcuate notches 65 may be formed with the rotator 40. In lieu of the rotator 40 and the notches 40*a* , the gear 45 may be formed with arcuate notches, or the projections 45*a* formed on the gear 45 of the driving device 70 may be in engagement with projections formed with the rotator 40 for projection to projection contact.

Figure 17:
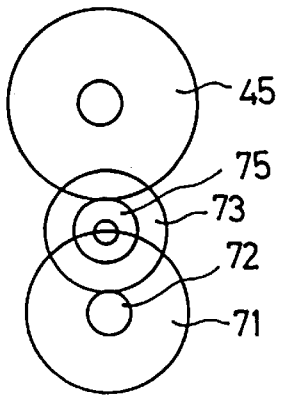
FIG. 17 is a side elevation of gear trains in the driving device according to another embodiment.
Figure 18:
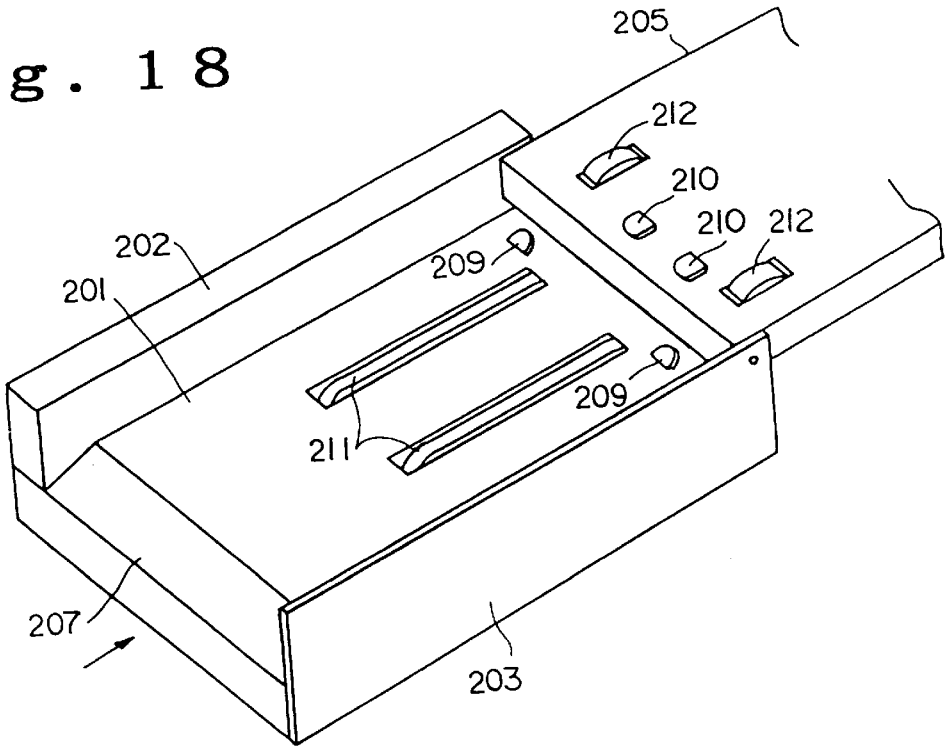
FIG. 18 is a perspective view of a prior art validator.
Figure 19:
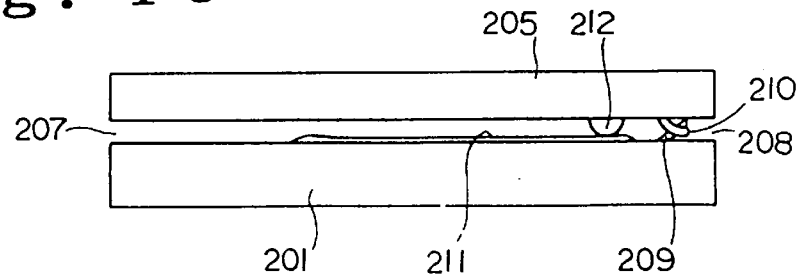
FIG. 19 is a side elevation of the validator shown in FIG. 18.

Moreover, as shown in FIG. 17, the small gear 75 may be directly meshed with the gear 45 attached to the shaft 43 of the rotator 40 in the driving device 70 of the rotator motor 71 and the large gear 73 without the middle gear 76.

POSSIBILITY OF THE INDUSTRIAL UTILIZATION

As mentioned above, the present invention can realize clear detection of a pulling means connected with a bill and wound around the rotator to surely prevent unauthorized extraction of the bill and prohibited access to the bill validator. Moreover, the rotator can be certainly stopped in position to prevent extraction of the bill, and at the moment the rotating rotator is stopped in position, the rotator can be prevented from damage which may be resulted by inertial force of the rotator motor.

What is claimed is:

1. A bill validator comprising a case:

a passageway formed in said case to guide a bill;

a conveyor for transporting said bill inserted from an inlet formed at one end of said passageway through said passageway to an outlet formed at the other end of said passageway;

a detective sensor disposed adjacent to said passageway;

a rotator formed with a slit in alignment with said passageway when said rotator is in an initial position;

a driving device for rotating said rotator;

a validator control circuit for receiving outputs from said detective sensor to judge authenticity of the bill and control said driving device so as to rotate said rotator and wind around said rotator a pulling means connected to said bill which has passed said slit of said rotator; and a lever with a roller resiliently urged toward said rotator for returning said rotator to the initial position.

2. A bill validator of claim 1, further comprising an encoder drivingly connected to said driving device for detecting the rotation rate of said rotator; and a cover member attached for surrounding said rotator;

wherein said lever permits to position said rotator in the initial position and to rotate said rotator only in a direction.

3. A bill validator of claim 1, further comprising a shaft for rotatably supporting said lever which has an end for rotatably holding said roller;

a spring for resiliently urging said roller toward an outer surface of said rotator; and a position sensor for detecting rotation of said lever;

wherein said driving device is drivingly connected with said rotator through an angular gap for relative rotation; said validator control circuit produces outputs to operate the driving device to rotate said rotator for a certain period of time after the bill passes through the slit of the rotator.

4. A bill validator of claim 2, further comprising a shaft for rotatably supporting said lever which has an end for rotatably holding said roller;

a spring for resiliently urging said roller toward an outer surface of said rotator; and a position sensor for detecting rotation of said lever;

wherein said driving device is drivingly connected with said rotator through an angular gap for relative rotation; said validator control circuit produces outputs to operate the driving device to rotate said rotator for a certain period of time after the bill passes through the slit of the rotator.

5. A bill validator of claim 1, wherein said driving device comprises a rotator motor, and a gear drivingly connected with said rotator motor; said rotator and gear are rotatably mounted on a same shaft with an angular gap for relative rotation of said rotator relative to said gear.

6. The bill validator of claim 5, wherein said gear includes a pair of projections; and said rotator includes a pair of arcuate notches for receiving said projections.

7. The bill validator of claim 1, wherein said case comprises a front housing which includes said detective sensor and a front passage of said passageway; and a rear housing positioned in the vicinity of said front housing; said rear housing including a rear passage of said passageway adjacently to said front passage;

said rotator and said driving device are disposed in one of said front and rear housings.

8. A bill validator of claim 7, wherein said rear housing is detachably attached to said front housing.

9. A bill validator of claim 1, wherein said slit of said rotator is kept uncomfortable from said passageway before the bill is inserted into said inlet.

10. A bill validator of claim 1, wherein an outlet sensor detects existence of said pulling means by rotation of said rotator after the bill is transported through said slit of said rotator and said outlet sensor.

11. A bill validator of claim 10, wherein said validator control circuit produces a warning signal to an alarm device when said outlet sensor detects said pulling means.

12. A method for detecting pulling means of a bill comprising the steps of:

transporting said bill inserted from an inlet along a passageway by a conveyor, picking up outputs produced by a detective sensor attached along said passageway during transportation of said bill and moving said bill through a slit formed in a rotator which is rotatably disposed along said passageway;

judging authenticity of said bill by a validator control circuit and transporting by said conveyor said bill considered genuine to a stacking device for packing;

after said bill passes through said passageway, rotating said rotator from the initial position of said slit in alignment with the passageway by a certain angular range and measuring the comparative rotation rate or time of said rotator by measuring. one of (1) a width of a pulse or (2) a time interval between pulses generated from an encoder connected with a rotator motor for rotating said rotator; and comparing the comparative rotation rate of time of said rotator with a reference rotation rate or time to detect existence of the pulling means when the comparative rotation rate is slower or the comparative rotation time is no longer.

13. A method of claim 12 further comprising:

measuring pulse width or time interval between pulses generated from said encoder connected with said rotator motor for rotating said rotator by the certain angular range to previously evaluate the unloaded reference rotation rate or time of said rotator before said bill is transported;

storing the previously evaluated reference rotation rate or time of said rotator;

transporting a bill inserted from an inlet along said passageway, validating said bill during the transportation, and then discharging said bill from an outlet of said passageway;

rotating said rotator by the certain angular range and measuring width of pulses and time intervals of pulses generated from said encoder connected with said rotator motor to then evaluate the comparative rotation rate or time for said rotator;

storing the evaluated comparative rotation rate or time of said rotator; and comparing the reference and comparative rotation rates or times of said rotator to detect existence of the pulling means when the comparative rotation rate is smaller than the reference rotation rate over a certain range or when the comparative rotation time is greater than the reference rotation time over a certain range.

14. A method of claim 12, further comprising detecting existence of said pulling means when the comparative rotation time of said rotator is longer than the unloaded reference rotation time of said rotator over a certain period of time.

* * * * *